US006194368B1

(12) United States Patent
Wäschenbach et al.

(10) Patent No.: US 6,194,368 B1
(45) **Date of Patent: *Feb. 27, 2001**

(54) DISHWASHER PRODUCT IN TABLET FORM

(75) Inventors: Guido Wäschenbach, Schriesheim; Paul Robinson, Ladenburg; Brigitte Sandmann, Heidelberg; Harald Magg, Ladenburg; Wilfried Höflinger, Schriesheim, all of (DE)

(73) Assignee: Joh A. Benckiser, GmbH, Ludwigshafen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/983,620

(22) PCT Filed: Jul. 15, 1996

(86) PCT No.: PCT/DE96/01283

§ 371 Date: Apr. 10, 1998

§ 102(e) Date: Apr. 10, 1998

(87) PCT Pub. No.: WO97/03177

PCT Pub. Date: Jan. 30, 1997

(30) Foreign Application Priority Data

Jul. 13, 1995 (DE) ..... 195 25 569

(51) Int. Cl.[7] ..... C11D 17/00; C11D 3/28; C11D 3/39

(52) U.S. Cl. ..... 510/224; 510/228; 510/230; 510/231; 510/233; 510/375; 510/378; 510/402

(58) Field of Search ..... 510/224, 228, 510/230, 231, 233, 375, 378, 402

(56) References Cited

U.S. PATENT DOCUMENTS

| | | | | |
|---|---|---|---|---|
| 3,962,107 | | 6/1976 | Levin et al. | 252/100 |
| 4,219,435 | * | 8/1980 | Biard et al. | 510/224 |
| 4,219,436 | * | 8/1980 | Groomer et al. | 510/224 |
| 4,578,207 | | 3/1986 | Holdt et al. | 252/134 |
| 4,683,072 | | 7/1987 | Holdt et al. | 252/102 |
| 5,089,270 | | 2/1992 | Hampton et al. | 424/465 |
| 5,133,892 | * | 7/1992 | Chun et al. | 510/224 |
| 5,453,216 | * | 9/1995 | Kellet | 510/224 |
| 5,783,540 | * | 7/1998 | Secemski et al. | 510/224 |
| 5,783,545 | * | 7/1998 | Paatz et al. | 510/305 |

FOREIGN PATENT DOCUMENTS

| | | | |
|---|---|---|---|
| 0481547 | 10/1990 | (EP) | C11D/17/00 |
| 0481793 | 10/1991 | (EP) | C11D/17/00 |
| 0504091 | 3/1992 | (EP) | C11D/3/00 |
| 0541475 | 11/1992 | (EP) | C11D/3/39 |
| 0634478 | 7/1993 | (EP) | C11D/3/39 |
| WO9426859 | 11/1994 | (WO) . | |
| WO9426860 | 11/1994 | (WO) . | |
| PCTUS9407045 | 1/1995 | (WO) | C11D/7/18 |

* cited by examiner

*Primary Examiner*—Margaret Medley
(74) *Attorney, Agent, or Firm*—Oppenheimer, Wolff & Donnelly LLP

(57) ABSTRACT

The invention relates to a dishwasher detergent in the form of a multi-layer tablet comprising a bleach, a bleach activator, a silver/copper corrosion inhibitor and also other customary constituents, where the silver/copper corrosion inhibitor is not present together with the bleach and the bleach activator in one layer.

8 Claims, No Drawings

DISHWASHER PRODUCT IN TABLET FORM

This application is a 371 of PCT/FR96/00893 filed on Jul. 15, 1996.

The present invention relates to a dishwasher detergent in the form of a tablet comprising a bleach and a bleach activator and also other customary constituents.

Conventional detergents for the machine cleaning of dishes are generally pulverulent, granular or liquid products. Cleaning compositions in the form of tablets have likewise been known for some years. In principle, products in the form of tablets have a number of advantages over pulverulent and liquid products: they do not require accurate measurement of the amount to be used and are therefore easier to handle and introduce into the dishwasher, they are more compact and therefore require less packing material and storage space and they are safer to use in the household since spillage of the often aggressive substances is not possible.

However, it has been found that cleaning compositions in tablet form can have a poorer cleaning action than those in powder form. This can be attributed to the fact that in pressed tablets the individual constituents are significantly more closely joined together than in, powders, so that negative interactions which individual constituents can exercise on one another can occur to a greater degree. But, partial inactivation of individual constituents can result. The applicant has now found that such a problem also occurs in the combined use of bleaches and bleach activators with silver/copper corrosion inhibitors.

A further problem which occurs in the case of dishwasher detergents in tablet form and which impairs washing performance is that such dishwasher detergents are less effective than comparable powders, since the tablets dissolve more slowly and therefore are available in the washing liquor only later than when powders are used. This problem occurs particularly in the case of dishwasher detergents containing a bleach, since when said compositions are used in tablet form the concentration of the bleach necessary for bleaching is reached only relatively late in the washing process. As a solution to this problem, it is proposed in EP-A 504 091 that a certain combination of alkali metal carbonate, polycarboxylate, a polyfunctional carboxylic acid, sodium silicate, a nonionic surfactant and the bleach be used so that the bleaching effect of the pressed tablets is retained.

EP-A 634 478 discloses dishwasher detergents comprising nitrogen-containing corrosion inhibitors and an oxygen-liberating bleach. According to the statements of this document, the dishwasher detergents can be present in any form and tablets too are mentioned in passing, with the difficulties which can occur in the formulation of corrosion inhibitors with bleaches or bleach activators obviously not having been recognized.

EP-A 481 547 discloses that during storage of a dishwasher detergent and in the aqueous cleaning solution in a dishwasher, enzymes are deactivated in the presence of a chlorine bleach. As a solution to this problem, EP-A 481 547 discloses a dishwasher detergent comprising enzymes and chlorine bleaches in the form of a tablet having at least three layers and a complex structure, comprising an inner layer, a barrier layer and an outer layer. The enzymes and the chlorine bleaches are thus separated in various layers of the tablet. This complex structure of the cleaning composition tablets is supposed to ensure that, on the one hand, no interface exists during storage between the layer containing the chlorine bleach and the layer containing the enzyme and, on the other hand, the two layers are not dissolved simultaneously but rather are dissolved in succession and therefore the chlorine bleach and the enzyme are not simultaneously present in the washing water of the dishwasher.

EP-A 1481 793 discloses cleaning compositions in tablet form which contain sodium percarbonate as bleach and are to be used in textile washing machines. In order to be able to obtain a storage-stable tablet which comprises not only sodium percarbonate but also other constituents which can interact with the bleach, it is proposed that percarbonate be separated in the tablet from the other constituents, for example in two layers. The tablets thus produced are, in addition, said to have an increased dissolution rate in the washing liquor.

EP-A 481 792 discloses a product in tablet form for the treatment of fabrics in washing machines, which product comprises, to improve the bleaching action, a combination of a per-salt and a bleach activator, with the bleach activator having to have a certain rate constant for the hydrolysis of the per-salt.

DE-A 25 27 534 discloses a multilayer cleaning tablet for dentures, with the first layer containing an enzyme and dissolving before the second layer containing active oxygen. By this means the enzyme can act at first without being deactivated by the active oxygen liberated.

It is an object of the present invention to provide a dishwasher detergent in the form of a tablet which comprises not only a bleach, a bleach activator and other customary constituents but also a silver/copper corrosion inhibitor which prevents the tarnishing of nonferrous metals on the dishes to be cleaned, with the silver/copper corrosion inhibitor not impairing the effectiveness of the tablet, but giving at least as good a washing performance as in the case of a comparable powder, preferably even better.

It is a further object of the invention to provide a dishwasher detergent in the form of a tablet which comprises not only a bleach, a bleach activator and other customary constituents but also a silver/copper corrosion inhibitor which prevents the tarnishing of nonferrous metals on the dishes to be cleaned, with the composition, although it is in tablet form and the individual constituents of the washing liquor are therefore available only in a later stage of the washing process, displaying a washing performance which is at least as good, preferably better, as that of the composition in powder form.

It has now surprisingly been found that tablets which consist of at least two layers and in which the silver/copper corrosion inhibitor is not present together with the bleach and the activator in one layer have an undiminished or even improved cleaning action compared with powders of the same composition, despite the fact that the tablet dissolves only during the course of the washing process and the constituents of the composition are therefore available only in a later stage of the washing process.

Furthermore, these effects occur not only in dishwasher detergents after a certain storage time, but surprisingly also in dishwasher detergents directly after manufacture, so that the effects occur independently of interactions which can take place in the composition during storage.

The present invention accordingly provides a dishwasher detergent in the form of a tablet comprising a bleach, a bleach activator and other customary constituents and additionally contains a silver/copper corrosion inhibitor, where the tablet consists of at least two layers and the silver/copper corrosion inhibitor is not present together with the bleach and the bleach activator in one layer.

Preferably, the tablet of the invention does not dissolve completely in the liquor of the dishwasher in less than three minutes.

For the purposes of the present invention, "dissolve completely" means that the tablets have disintegrated to the extent that in agitated water at 40° C. they can pass through a basket having 4 mm openings.

The bleaches present in the dishwasher detergents of the invention are preferably chlorine-free bleaches which liberate active oxygen, for example inorganic perhydrates or organic peracids and their salts.

Examples of inorganic perhydrates are perborates, percarbonates and persulfates such as peroxo monopersulfates. The inorganic perhydrates are normally alkaline metal salts such as lithium, sodium, potassium, or rubidium salts, in particular the sodium salts. The inorganic perhydrates can be present in the detergent as crystalline solids without further protection. However, for certain perhydrates it is advantageous to use them as granular compositions which are provided with a coating which gives the granular products a better storage stability.

The preferred perborate is sodium perborate which can be present as the monohydrate having the formula $NaBO_2H_2O_2$ or as the tetrahydrate having the formula $NaBO_2H_2O_2.3H_2O$.

The preferred percarbonate is sodium percarbonate having the formula $2Na_2CO_3 3H_2O_2$. The percabonate is preferably used in a coated form to increase its stability.

Organic peracids include all organic peracids customarily used as bleaches, including, for example, perbenzoic acid and peroxycarboxylic acids such as monoperoxyphthalic or diperoxyphthalic acid, octyldiperoxisuccinic acid, diperoxydodecane dicarboxylic acid, diperoxyazelaic acid and an imidoperoxycarboxylic acid and also possibly their salts.

Furthermore, chlorine-containing bleaches such as sodium dichloroisocyanurate or sodium trichloroisocyanurate can be present in the detergent of the invention.

The bleach is normally present in the detergent in an amount of from 1 to 40% by weight, preferably from 2 to 30% by weight and most preferably from 5 to 20% by weight, of the total weight of the tablet.

The dishwasher detergent of the invention additionally contains one or more bleach activators. These are preferably used in detergents for dishwashing processes at temperatures in the range below 60° C. in order to achieve sufficient bleaching action. Particularly suitable activators are, for example, N- and O-acyl compounds such as acylated amines, acylated glycol urils or acylated sugar compounds. Preference is given to N,N,N',N'-tetraacetylethylendiamine (TAED), pentaacetylglucose (PAG) and tetraacetyl (glycol uril) (TAGU). Other suitable bleach activators are catalytically active metal complexes and preferably transition metal complexes. Most preferred is TAED.

Further suitable bleach activators are disclosed in WO 95/01416 the content of which is hereby expressly incorporated by reference.

The bleach activator can be present in the detergent of the invention in an amount from 0.1 to 20% by weight and preferably from 1 to 10% by weight of the total weight, of the tablet.

The dishwasher detergent of the invention additionally contains a silver/copper corrosion inhibitor. This term encompasses agents which are supposed to prevent or reduce the tarnishing of nonferrous metals, in particular of silver and copper. Preferred silver/copper corrosion inhibitors are benzotriazole or bisbenzotriazoles and also their substituted derivatives.

Further suitable agents are organic and/or inorganic redox-active substances and paraffin oil.

Benzotriazole derivatives are compounds in which the available substitution positions of the aromatic ring are partially or completely substituted. Suitable substituents are linear or branched $C_{1-20}$-alkyl groups and also hydroxy, thio, phenyl or halogen such as flourine, chlorine, bromine and iodine. The preferred substituted benzotr-iazole is tolyltriazole.

Suitable bisbenzotriazoles are those in which the benzotrilazole groups are, in each case in the 6 position joined by means of a group X, where X can be a bond, a straight-chain alkylene group which may be substituted by one or more $C_{1-4}$-alkyl groups and preferably has 1–6 carbon atoms, a cycloalkyl radical having at least 5 carbon atoms, a carbonyl group, a sulfuryl group, and oxygen or a sulfur atom. The aromatic rings of the bisbenzotriazole can be substituted as defined above for benzotriazole.

Suitable organic redox-active substances are, for example, ascorbic acid, indol, methionin, an N-mono ($C_1$-$C_4$-alkyl)glycine, an N,N-Di-($C_1$-$C_4$-alkyl)glycine, 2-phenylglycine or a coupler and/or developer compound selected from the group consisting of diaminopyridines, aminohydroxypyridines, dihydroxypyridines, heterocyclic hydrazones, aminohydroxypyrimidines, dihydroxypyrimidines, tetraaminopyrimidines, triaminohydroxypyrimidines, diaminodihydroxypyrimidines, dihydroxynaphthalines, naphthols, pyrazolones, hydroxyquinolines, aminoquinolines, primary aromatic amines which in the ortho, meta or para position bear a further free or $C_1$-$C_4$-alkyl-substituted or $C_2$-$C_4$-hydroxyalkyl-substituted hydroxy or amino group, and dihydroxybenzines or trihydroxybenzines.

Suitable inorganic redox-active substances are, for example, metal salts and/or metal complexes selected from the group consisting of manganese, titanium, zirconium, hafnium, vanadium, cobalt and cerium salts and/or complexes where the metals are present in the oxidation states II, III, IV, V or VI.

Particularly suitable are metal salts and/or metal complexes selected from the group consisting of $MnSO_4$, manganese(II) citrate, manganese(II) stearate, manganese (II) acetylacetonate, manganese (II) 1-hydroxyethane-1,1-diphosphonate, $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$.

Organic and inorganic redox-active substances which are suitable as silver/copper corrosion inhibitors are also mentioned in WO 94/26860 and WO 94/26859 the content of which is hereby incorporated by reference.

Suitable paraffin oils are predominantly branched aliphatic hydrocarbons having a number of carbon atoms in the range from 20 to 50. The paraffin oil is preferably selected from among primarily branched $C_{25-45}$ species having a ratio of cyclic to noncyclic hydrocarbons of from 1:10 to 2:1, preferably from 1:5 to 1:1.

The silver/copper corrosion inhibitor is present in the dishwasher detergent of the present invention in an amount of preferably from 0.01 to 5% by weight, particularly preferably from 0.1 to 2% by weight, of the total weight of the tablet.

The dishwasher detergent of the invention can additionally contain other customary constituents. These include builders, sequestering agents, surface active agents, enzymes, foam inhibitors, fragrances, dyes and other auxiliaries.

Suitable builders are, for example, homopolymeric and copolymeric polycarboxylic acids and their partially or fully neutralized salts, monomeric polycarboxylic acids and hydroxycarboxylic acids and their salts, carbonates, bicarbonates, borates, phosphates, silicates, aluminosilicates and also mixtures of such substances.

As salts of the abovementioned compounds, preference is given to using the ammonium and/or alkali metal salts, i.e. the lithium, sodium, potassium and rubidium salts, and particularly preferably the sodium salt.

Suitable polycarboxylic acids are acyclic, alicyclic, heterocyclic and aromatic carboxylic acids containing at least two carboxy groups which are in each case separated from one another by preferably not more than two carbon atoms.

Polycarboxylates containing two carboxy groups include, for example, water-soluble salts of succinic acid, malonic acid, (ethylenedioxy)diacetic, acid, maleic acid, diglycolic acid, tartaric acid, tartronic acid and fumaric acid. Polycarboxylates containing three carboxy groups include, for example, water-soluble citrates. Correspondingly, an example of a suitable hydroxycarboxylic acid is citric acid.

Also suitable as a polycarboxylic acid is the homopolymer of acrylic acid.

As borate builders, it is possible to use borates such as sodium borate and also builders comprising borate-forming materials which liberate borates under the storage conditions for the cleaning composition or under the washing conditions.

Suitable phosphates are polyphosphates such as tripolyphosphate, pyrophosphate, orthophosphate and the polymeric mataphosphate. Examples which may be mentioned are alkali metal tripolyphosphates, sodium, potassium and ammonium pyrophosphate, sodium and potassium orthophosphate and also sodium polymetaphosphate in which the degree of polymerization preferably extends from 5 to 21.

Suitable silicates are sodium silicates such as sodium disilicate, sodium metasilicate and crystalline sheet silicates. Also suitable are sodium aluminosilicates (zeolites).

Further suitable builders are disclosed in WO 95/01416, the content of which is hereby expressly incorporated by reference.

The dishwasher detergent of the invention can contain from 40 to 90% by weight, preferably from 60 to 80% by weight, of builders, based on the total weight of the tablet. Use can here be made of either individual builders or mixtures of various abovementioned builders. For example, mixtures of carbonates and silicates are suitable.

Suitable sequestering agents for complexing heavy metal ions which can be used according to the invention acre organic phosphonates such as amino-alkylene poly (alkylenephosphonate), alkali metal ethane-1-hydroxydiphosphonate and nitrilotrimethylenephosphonates. Preferred phosphonates are diethylenetriamine penta (methylenephosphonate), hexamethylenedi-amine tetra (methylenephosphonate) and hydroxyethylene 1,1-diphosphonate. Also suitable are aminopolycarboxylates such as nitrilotriacetic acid (NTA), methylglycinediacetic acid (MGDA) and also polyaspartates.

According to the invention, the sequestering agent can be present in an amount of from 0.01 to 10% by weight, preferably from 0.1 to 2% by weight, of the total weight of the tablet.

Suitable surface-active agents are, for example, nonionic surface-active agents. These include, for example, water-soluble ethoxylated $C_{6-16}$ fatty alcohols and $C_{6-16}$ mixed ethoxylated/propoxylated fatty alcohols and mixtures thereof, and also alkylpolygluclosides.

A further class of nonionic surface-active agents comprises polyhydroxy fatty amides.

Further suitable surface-active agents are disclosed in WO 95/01416, the content of which is hereby expressly incorporated by reference.

According to the invention, the surface-active agent can be present in an amount of from 0.1 to 10% by weight, preferably from 1 to 5% by weight, of the total weight of the tablet.

The dishwasher detergent of the invention can additionally contain one or more enzymes customarily used in detergents and selected from, for example, proteasers amylases, lipases and esterases.

The enzymes can be present in the detergent in an amount of from 0.1 to 10% by weight, preferably from 1 to 5% by weight, of the total weight of the detergent.

The dishwasher detergent of the invention can additionally contain one or more foam inhibitors. Suitable foam inhibitors are all those used in this field, for example silicones and paraffin oils.

The foam inhibitors are preferably present in the dishwasher detergent of the invention in an amount of less than 5% by weight of the total weight of the detergent.

Furthermore, the dishwasher detergent of the invention can comprise other customary additives such as fragrances, dyes and/or further auxiliaries. For example, it is possible to use various polymers such as polyvinylpyrrolidone, polyvinylpolypyrrolidone or polyethylene glycol (preferably having a molecular weight of 10–10,000) or glycerol as auxiliaries which aid the production of the tablets.

A preferred dishwasher detergent of the invention consists of two layers, where the first layer comprises, a) a perborate as bleach, b) sodium tripolyphosphate, a disilicate and a carbonate as builders, d) a nonionic surface-active agent, d) benzotriazole as silver/copper corrosion inhibitor and also, if desired, further auxiliaries and the second layer comprises, a) N,N,N',N'-tetraacetylethylenediamine as bleach activator, b) sodium tripolyphosphate, a homopolymeric acrylic acid polymer and a carbonate as builders, c) a phosphonate as sequestering agent, d) a nonionic surface-active agent, e) one or more enzymes and also, if desired, further auxiliaries.

A further preferred dishwasher detergent of the invention consists of two layers, where the first layer comprises a) a perborate as bleach, b) a citrate, a bicarbonate, and a carbonate as builders, c) a nonionic surface-active agent, d) benzotriazole as silver/copper corrosion inhibitor and also, if desired, further auxiliaries and the second layer comprises a) N,N,N',N'-tetraacetylethylenediamine as bleach activator, b) citrate, a bicarbonate, a carbonate, a homopolymeric acrylic acid polymer and citric acid as builders, c) a phosphonate as sequestering agent, d) a nonionic surface-active agent, e) one or more enzymes and also, if desired, further auxiliaries.

The tablets of the present invention can be produced by any conventional method known in the prior art. For example, the constituents of the individual layers are separately premixed and then pressed together in layers in order to obtain a tablet. The hardness of the tablet and the time which this tablet requires to dissolve completely is dependent, inter alia, on the pressure used during pressing. The lower the pressure during the pressing process, the more crumbly is the tablet obtained and the quicker it dissolves in the washing liquor. A higher pressure leads to stronger tablets which dissolve correspondingly more slowly. For example, pressures of from 0.01 to 70 $kN/cm^2$ are suitable for the pressing process.

Furthermore, the pressing process can be defined by the force required to break the tablets obtained in this way. Such measurements of the hardness of the tablet can, for example, be carried out using an Erickson 464H hardness testing machine. The tablets of the invention preferably have a hardness of 90–130 N.

The size of the tablets of the invention depends on the desired amount of dishwasher detergent which is to be present in the tablet. For example, the tablet can weigh 15–25 g. The tablet preferably contains the amount of dishwasher detergent which is required for one wash. However, the tablet can also consist of larger units which for dosage purposes can, for example, be broken at a prescribed fracture position into smaller parts in dose form.

The tablet can have any suitable shape, in particular with a constant thickness, for example round or rectangular.

The following examples illustrate the present invention. Percentages are by weight.

Example 1

Two layer tablets of the following composition (Table 1) were produced on a production scale using a high-speed rotation press. The tablets weighed a total of 18 g, with 12.6 g being in the first layer and 5.4 g in the second layer. A pulverulent composition having the same amounts of constituents as the total amount in the two-layer tablet was likewise produced (Table 1). The only difference between the two preparations was the product form. The tablet was pressed such that the force required to break the tablet was approximately 110 N. This measurement was carried out using an Erickson 464H hardness testing machine.

The dissolution rate of the tablets was likewise determined. The determination was carried out by measuring the time which the tablets required to disintegrate to such a degree that they could pass through 4 mm openings in a basket immersed in agitated water at 40° C. This result is likewise shown in Table 1.

TABLE 1

| Constituents | 1st Layer % | 2nd Layer % | Total Tablet % | Powder % |
|---|---|---|---|---|
| Perborate | 16.00 | | 11.20 | 11.20 |
| TAED | | 6.83 | 2.05 | 2.05 |
| STPP | 48.00 | 50.87 | 48.86 | 48.86 |
| Disilicate | 5.00 | | 3.50 | 3.50 |
| Carbonate | 18.64 | 25.51 | 20.70 | 20.70 |
| Phosphonate | | 2.72 | 0.82 | 0.82 |
| Polymer | | 2.72 | 0.82 | 0.82 |
| Nonionic surface-active agent | 4.50 | 2.07 | 3.77 | 3.77 |
| Protease | | 3.37 | 1.01 | 1.01 |
| Amylase | | 1.33 | 0.40 | 0.40 |
| BTA | 0.36 | | 0.25 | 0.25 |
| PEG | 6.00 | 4.08 | 5.42 | 5.42 |
| Glycerol | 1.50 | 0.50 | 1.20 | 1.20 |
| Total | 100 | 100 | 100 | 100 |
| Dissolution | | | ca. 10 min | 0 min* |

*The powder has a dissolution time of 0 since all particles have a size of less than 4 mm.
TAED = N,N,N',N'-tetraacetylethylenediamine
STPP = Sodium tripolyphosphate
BTA = Benzotriazole
PEG = Polethylene glycol
Polymer = Homopolymeric acrylic acid polymer The action of both the two-layer tablet and the powder of the same composition was then determined in accordance with DIN 44990. This method describes the testing of dishwasher detergents by means of a visual determination of the action on a scale from 1 to 5 (where 5 is assumed to be perfectly clean). A dishwasher from Bosch was used with the normal 65° C. wash program. The water hardness was 18° d. Five washes were carried out for each product, with in each case the product being automatically metered in by means of the machine's own detergent dispensing device.

The results for milk, which is a significant, enzyme-relevant form of soiling are shown in Table 2.

TABLE 2

| Soiling | Two-Layer Tablet | Powder |
|---|---|---|
| Milk | 3.22 | 3.08 |

Example 2

Two-layer tablets were produced on a production scale using a high-speed rotation press. The tablets weighed 20 g, the first layer contained 14 g and the second layer contained 6 g (Table 3). The tablets were pressed sufficiently to gain a hardness of 100 N (same hardness testing machine as in Example 1). Again, a pulverulent composition having the same formulation was also produced (Table 3). The dissolution time of the two-layer tablets is shown in Table 3.

TABLE 3

| Constituents | 1st Layer % | 2nd Layer % | Total Tablet % | Powder % |
|---|---|---|---|---|
| Perborate | 14.3 | | 10.01 | 10.01 |
| TAED | | 25.00 | 7.50 | 7.50 |
| Citrate | 50.01 | 26.37 | 42.92 | 42.92 |
| Bicarbonate | 24.57 | 17.20 | 22.36 | 22.36 |
| Carbonate | 7.21 | 4.78 | 6.48 | 6.48 |
| Phosphonate | | 1.66 | 0.50 | 0.50 |
| Polymer | | 1.66 | 0.50 | 0.50 |
| Citric acid | | 10.00 | 3.00 | 3.00 |
| Nonionic surface-active agent | 3.00 | 1.00 | 2.40 | 2.40 |
| Protease | | 9.00 | 2.70 | 2.70 |
| Amylase | | 3.30 | 0.99 | 0.99 |
| BTA | 0.36 | | 0.25 | 0.25 |
| Glycerol | 0.50 | | 0.35 | 0.35 |
| Perfume | 0.05 | | 0.04 | 0.04 |
| Fragrance | | 0.03 | 0.01 | 0.01 |
| Total | 100 | 100 | 100 | 100 |
| Dissolution | | | ca. 8 min | 0 min |

The action of both the two-layer tablet and the power of the same composition was then determined in accordance with DIN 44990. A dishwasher from Bosch was used with the normal 65° C. wash program. The water hardness was 18° d.

The results for milk, which is a significant, enzyme-relevant form of soiling, are shown in Table 4.

TABLE 4

| Soiling | Two-Layer Tablet | Powder |
|---|---|---|
| Milk | 3.20 | 2.88 |

Comparative Example 3

In this example, single-layer tablets were produced in accordance with a composition already on the market. The tablets were pressed such that the strength of the tablets was about 125 N. The dissolution time was likewise measured and the results are shown in Table 5. A pulverulent composition of the same formulation was likewise produced. The composition is shown in Table 5.

TABLE 5

| Constituents | Single-Layer Tablet % | Powder % |
|---|---|---|
| Carbonate | 16.60 | 16.60 |
| Percarbonate | 21.90 | 21.90 |
| STPP | 45.70 | 45.70 |
| Disilicate | 5.90 | 5.90 |
| Phosphonate | 2.00 | 2.00 |
| PEG | 1.00 | 1.00 |
| Protease | 1.0 | 1.0 |
| Amylase | 0.4 | 0.4 |
| Nonionic surface-active agent | 4.25 | 4.25 |
| BTA | 0.25 | 0.25 |
| Glycerol | 1.00 | 1.00 |
| Total | 100 | 100 |
| Dissolution | ca. 13 min | 0 min |

The action of both the tablet and the powder was again determined in accordance with DIN 44990. As before, a dishwasher from Bosch was used. Again, the normal 65° C. wash program was used and the water had a hardness of 18° d.

The results for milk, which is a significant enzyme-relevant form of soiling, are shown in Table 6.

TABLE 6

| Soiling | Single-Layer Tablet | Powder |
|---|---|---|
| Milk | 3.31 | 3.88 |

It is clear from these examples and comparative examples that a dishwasher detergent of the invention which is built up as a simple two-layer tablet gives a better washing performance than a comparable powder, although the individual constituents of the composition of the invention are completely available for washing only after from about 8 to 13 minutes, while in the case of a comparable powder all constituents are immediately available.

What is claimed is:

1. A dishwasher detergent in the form of a tablet, the tablet comprising a chlorine-free bleach which liberates active oxygen, a bleach activator and a silver/copper corrosion inhibitor, the tablet having at least two layers, the silver/copper corrosion inhibitor and the bleach being present in a first layer and the bleach activator being present in a second layer.

2. A dishwasher detergent as claimed in claim 1, wherein the total tablet dissolves completely in the liquor of the dishwasher in not less than three minutes.

3. A dishwasher detergent as claimed in claims 1 or 2, wherein the silver/copper corrosion inhibitor is selected from the group consisting of benzotriazole, bisbenzotriazoles, benzotriazole derivatives in which the available substitution positions of the aromatic ring are partially or fully substituted, bisbenzotriazole derivatives in which the available substitution positions of the aromatic rings are partially or fully substituted, organic and/or inorganic redox-active substances, and paraffin oil.

4. A dishwasher detergent as claimed in claims 1 or 2, wherein the bleach is selected from the group consisting of perborates, percarbonates, peroxomonopersulphates, organic peracids, and salts of organic peracids.

5. A dishwasher detergent as claimed in claims 1 or 2, wherein the bleach activator is selected from the group consisting of N,N,N',N'-tetraacetylethylenediamine (TAED), pentaacetylglucose (PAG), tetraacetylglycoluril (TAGU), and catalytically active metal complexes.

6. A dishwasher detergent as claimed in claims 1 or 2, additionally containing one or more constituents selected from the group consisting of builders, sequestering agents, chlorine bleaches, surface-active agents, enzymes, foam inhibitors, fragrances, and dyes.

7. A dishwasher detergent consisting of two layers, where the first layer comprises: (a) a perborate as bleach; (b) sodium tripolyphosphate, a disilicate and a carbonate as builders; (c) a nonionic surface-active agent; and (d) benzotriazole as silver/copper corrosion inhibitor; and the second layer comprises: (a) N,N,N',N'-tetraacetylethylenediamine as bleach activator; (b) sodium tripolyphosphate, a homopolymeric acrylic acid polymer, and a carbonate as builders, (c) a phosphonate as sequestering agent; (d) a nonionic surface-active agent; and (e) one or more enzymes.

8. A dishwasher detergent consisting of two layers, where the first layer comprises: (a) a perborate as bleach; (b) a citrate, a bicarbonate, and a carbonate as builders; (c) a nonionic surface-active agent; and (d) benzotriazole as silver/copper corrosion inhibitor; and the second layer comprises: (a) N,N,N',N'-tetraacetylethylenediamine as bleach activator; (b) a citrate, a bicarbonate, a homopolymeric acrylic acid polymer and citric acid as builders; (c) a phosphonate as sequestering agent; (d) a nonionic surface-active agent, and (e) one or more enzymes.

* * * * *